US006302018B1

(12) United States Patent
Aoyama et al.

(10) Patent No.: US 6,302,018 B1
(45) Date of Patent: Oct. 16, 2001

(54) OFFSET PRINTER HAVING POWER TRANSMISSION SHUT OFF MECHANISM

(75) Inventors: Hideo Aoyama; Naritoshi Tahara; Dong Liang, all of Fuchu (JP)

(73) Assignee: Ryobi Ltd., Hiroshima-Ken ( * ) Notice: Subject to any disclaimer, the term of this patent is extended or adjusted under 35 U.S.C. 154(b) by 0 days.

(21) Appl. No.: 09/614,452

(22) Filed: Jul. 12, 2000

(30) Foreign Application Priority Data

Jul. 19, 1999 (JP) ..... 11-204793

(51) Int. Cl.[7] ..... B41F 16/00

(52) U.S. Cl. ..... 101/142; 101/183; 101/216; 101/247

(58) Field of Search ..... 101/142, 144, 101/136, 137, 181, 183, 216, 230, 247, 248

(56) References Cited

U.S. PATENT DOCUMENTS

| | | | | |
|---|---|---|---|---|
| 3,742,244 | * | 6/1973 | Raible | 101/132 |
| 3,771,446 | * | 11/1973 | Kaneko et al. | 101/144 |
| 4,222,326 | * | 9/1980 | Mathes | 101/183 |
| 4,411,194 | * | 10/1983 | Davidson, Jr. | 101/216 |
| 4,669,380 | * | 6/1987 | Seib et al. | 101/216 |
| 4,889,051 | * | 12/1989 | Sarda | 101/137 |
| 5,156,638 | * | 10/1992 | Wirz | 101/142 |
| 5,272,975 | * | 12/1993 | Dettinger et al. | 101/248 |
| 5,469,787 | * | 11/1995 | Turner et al. | 101/136 |
| 5,524,541 | * | 6/1996 | Schwinn et al. | 101/484 |
| 5,613,438 | * | 3/1997 | Rehberg | 101/216 |
| 5,676,055 | * | 10/1997 | Schwinn et al. | 101/216 |
| 6,205,919 | * | 3/2001 | Simeth | 101/183 |

FOREIGN PATENT DOCUMENTS 9-510410 10/1997 (JP) .

* cited by examiner

*Primary Examiner*—Eugene Eickholt
(74) *Attorney, Agent, or Firm*—Sughrue, Mion, Zinn, Macpeak & Seas, PLLC

(57) ABSTRACT

An offset printer includes a drive motor, an impression cylinder gear, a paper feed cylinder, a paper feed cylinder gear, a paper discharge portion, a paper discharge gear, a blanket gear, a plate cylinder gear, an ink reciprocation roller, a mechanism for rotating the ink reciprocation roller, a mechanism for reciprocating the ink reciprocation roller, and first through fourth electromagnetic clutches. Rotation of the drive motor is transmitted to the paper feed cylinder gear and the paper discharge gear through the impression cylinder gear. The rotation force of the impression cylinder gear is also transmitted to, in the order of, the blanket cylinder gear, the plate cylinder gear, and the rotation and reciprocation mechanisms. Driving connection between the paper feed cylinder gear and the paper feed cylinder is selectively disconnected by the first clutch. Driving connection between the paper discharge gear and the paper discharge portion is selectively disconnected by the second clutch. Driving connection between the plate cylinder gear and the ink reciprocation roller is selectively disconnected by the third and fourth clutch.

11 Claims, 7 Drawing Sheets

OFFSET PRINTER HAVING POWER TRANSMISSION SHUT OFF MECHANISM

BACKGROUND OF THE INVENTION

The present invention relates to an offset printer, and more particularly, to a digital offset printer in which rotation of a drive motor is transmitted to a paper feed mechanism and a paper discharge mechanism through an impression cylinder, and also transmitted to an ink reciprocation roller through the impression cylinder, a blanket cylinder and a plate cylinder.

Japanese Patent Application Publication No. 9-510410 discloses an offset printer capable of performing offset printing with four different colors of inks. The printer includes a single impression cylinder, a single paper discharge mechanism, a single paper feed conveyer, a single transfer drum, two blanket cylinders, two plate cylinders and, ink rollers for the four colors. The paper feed conveyer and the transfer drum are adapted for delivering a paper to a surface of the impression cylinder. The paper is mounted on the surface of the impression cylinder. The paper discharge mechanism is adapted to discharge the paper from the impression cylinder. The blanket cylinder is pressed against the paper mounted on the impression cylinder.

The impression cylinder is rotated about its axis by the drive motor. Further, two blanket cylinders have their axes extending in a direction parallel with the axis of the impression cylinder, and the two blanket cylinders are in contact with the impression cylinder and are rotated upon rotation of the impression cylinder. The paper feed conveyer, the transfer drum and the paper discharge mechanism are also driven or rotated by the rotation of the impression cylinder.

Each plate cylinder has a peripheral surface provided with a thin plate where an image to be printed is formed. The two plate cylinders have their axes extending in a direction parallel with the axes of the blanket cylinders. Each plate cylinder is in contact with each blanket cylinder, and each plate cylinder is rotated upon rotation of each blanket cylinder. Each peripheral surface of the plate cylinder is divided into two segments. One of the segments is formed with an image with a single color, and remaining segment is formed with an image with a different color. Accordingly, the two plate cylinders form images of four colors.

The ink roller is adapted for supplying an ink to the plate of the plate cylinder. To this effect, two ink rollers are provided in contact with each plate cylinder so that two different colored inks can be supplied to each plate. Accordingly, totally four ink rollers are provided for four different colors. Axes of the ink rollers extend in parallel with the axis of the plate cylinder. The ink rollers are rotated upon rotation of the plate cylinder.

In the digital offset printer, the plate cylinders must be rotated about their axes so as to form images on the plates. This is similar to a laser printer in which a photo-sensitive drum is rotated so as to form an electro-static latent image on an outer peripheral surface of the drum. The drive motor, which is a single drive source, is driven to rotate the plate cylinder.

SUMMARY OF THE INVENTION

However, in the conventional digital offset printer, driving force of the motor must be transmitted to the plate cylinder by way of the impression cylinder and the blanket cylinders in order to rotate the plate cylinder for image formation thereon. Accordingly, the paper feed conveyer, the transfer drum and paper discharge mechanism are also rotated or driven by the rotation of the impression cylinder. Further, the ink rollers are also rotated upon rotation of the plate cylinders. However, the paper feed conveyer, the transfer drum, the paper discharge mechanism and the ink rollers make no contribution for forming images on the plate cylinders.

Reduction in time period requiring for the image formation is one of the factors in reduction in time period requiring for entire printing operation. In order to reduce the image forming period, the rotation speed of the plate cylinders must be increased. However, the rotation of the plate cylinders also causes rotation or driving of the other components which are not necessary for image formation on the plate. Therefore, high speed rotation of the plate cylinders may not be provided, and otherwise loss in rotation force may be increased, and the main body of the offset printer may be vibrated due to the concurrent rotations or driving.

It is therefore, an object of the present invention to provide an offset printer capable of shutting off the power transmission to components during a process for forming an image on the surface of the plate cylinder, the components being nothing to do with the image formation during this process.

This and other objects of the present invention will be attained by an offset printer including a frame, a drive motor supported on the frame, a drive gear for outputting a rotation force of the drive motor, an impression cylinder, a paper feed mechanism, a paper discharge mechanism, a blanket cylinder, a plate cylinder, an ink supplying mechanism, and a power transmission shut off mechanism. The impression cylinder has an impression cylinder gear provided coaxially and integrally rotatable therewith. The impression cylinder gear is meshedly engaged with the drive gear for rotating the impression cylinder upon rotation of the output gear. The paper feed mechanism includes a paper feed cylinder gear meshedly engaged with the impression cylinder gear, and a paper feed cylinder rotatable coaxially with the paper feed cylinder gear upon rotation of the impression cylinder gear for feeding a paper to a surface of the impression cylinder. The paper discharge mechanism includes a paper discharge gear meshedly engaged with the impression cylinder gear, a paper discharge portion rotatable coaxially with the paper discharge gear, and an endless chain mounted on the paper discharge portion and circularly movable on the paper discharge portion for removing the paper from the impression cylinder. The blanket cylinder is in contact with the surface of the impression cylinder and has a blanket cylinder gear meshedly engaged with the impression cylinder gear. The blanket cylinder gear is rotatable integrally with the blanket cylinder gear upon rotation of the impression cylinder gear. The plate cylinder has a plate cylinder gear meshedly engaged with the blanket cylinder gear. The plate cylinder is rotatable integrally and coaxially with the plate cylinder gear upon rotation of the blanket cylinder gear and in contact with a surface of the blanket cylinder for forming an image on a surface of the plate cylinder. The ink supplying mechanism is driven by the rotation of the plate cylinder for supplying an ink to the surface of the plate cylinder. An inked image is formed on the surface of the plate cylinder by the supplied ink based on an image formed on the surface of the plate cylinder, and the inked image on the plate cylinder is transferred to the surface of the blanket cylinder, and the impression cylinder presses a paper against the surface of the blanket cylinder for transferring the inked image on the blanket cylinder to the paper. The power transmission shut off mechanism is adapted for preventing the rotation force of the drive motor from being transmitted to at least one of the paper feed mechanism, the paper discharge mechanism and the ink supplying mechanism at least during image formation process on the surface of the plate cylinder.

With the structure, because the transmission of rotation force from the drive motor to at least one of the paper feed mechanism, the paper discharge mechanism and the ink supplying mechanism is shut off during the image forming process on the surface of the plate cylinder, it becomes possible to avoid idle driving of at least one of the above described mechanisms which driving is unnecessary for the image formation. For example, if the power transmission from the drive motor to the paper feed mechanism is shut off, the power transmission to the paper feed cylinder can be shut off. If the power transmission from the drive motor to the paper discharge mechanism is shut off, the rotation force is not transmitted to the paper discharge portion, thereby reducing unnecessary rotation of the paper discharge portion. If the power transmission from the drive motor to the ink supplying mechanism is shut off, idle driving of the ink supplying mechanism can be obviated, which driving is unnecessary for the image formation. In any case, rotation or driving of the mechanisms which are unnecessary for forming an image on the surface of the plate cylinder can be dispensed with. Accordingly, high speed rotation of the plate cylinder results, and in other words, the plate cylinder can be rotated with lesser power. Thus, image forming process can be efficiently performed. Further, unwanted vibration of the mechanism due to unwanted operation or driving of the mechanism(s) can be eliminated, thereby improving durability of the offset printer and prolonging service life thereof.

In a preferred embodiment, the power transmission shut off mechanism includes an electromagnetic clutch positioned between the paper feed cylinder gear and the paper feed cylinder for selectively coupling the paper feed cylinder gear and the paper feed cylinder. Further, a first rotation preventing member having a first locking projection engageable with the paper feed cylinder is provided for preventing the paper feed cylinder from being rotated with respect to the frame when the electromagnetic clutch disconnects the paper feed cylinder gear from the paper feed cylinder. The first locking projection is disengageable from the paper feed cylinder for allowing the paper feed cylinder to be rotatable with respect to the frame when the electromagnetic clutch couples the paper feed cylinder gear to the paper feed cylinder. An outer surface of the paper feed cylinder has a paper feed cylinder pawls with which the paper is held.

With this arrangement, in OFF phase of the electromagnetic clutch, the paper feed cylinder gear is disconnected from the paper feed cylinder, so that the transmission of rotation force from the paper feed cylinder gear to the paper feed cylinder is shut off. In this instant, by the locking engagement of the first locking projection with the paper feed cylinder, free rotation of the paper feed cylinder can be prevented. Accordingly, paper feed cylinder pawls can be stably positioned away from the surface of the impression cylinder, to thereby preventing the pawls from being obstacles against the rotation of the impression cylinder.

Further, in the preferred embodiment, the power transmission shut off mechanism includes an electromagnetic clutch positioned between the paper discharge gear and the paper discharge portion for selectively coupling the paper discharge gear and the paper discharge portion. Further, a second rotation preventing member having a second locking projection engageable with the paper discharge portion is provided for preventing the paper discharge portion from being rotated with respect to the frame when the electromagnetic clutch disconnects the paper discharge gear from the paper discharge portion. The second locking projection is disengageable from the paper discharge portion for allowing the paper discharge portion to be rotatable with respect to the frame when the electromagnetic clutch couples the paper discharge gear to the paper discharge portion. The endless chain is provided with paper discharge grippers.

With this arrangement, in OFF phase of the electromagnetic clutch, the paper discharge gear is disconnected from the paper discharge portion, so that the transmission of rotation force from the paper discharge gear to the paper discharge portion is shut off. In this instant, by the locking engagement of the second locking projection with the paper discharge portion, free rotation of the paper discharge portion can be prevented. Accordingly, paper discharge grippers can be stably positioned away from the surface of the impression cylinder during the image formation process, to thereby preventing the grippers from being obstacles against the rotation of the impression cylinder.

Further, in the preferred embodiment, the power transmission shut off mechanism includes a clutch positioned between the plate cylinder and the ink supplying mechanism for selectively shutting off transmission of rotation force of the plate cylinder to the ink supplying mechanism.

With this arrangement, in OFF phase of the clutch, rotation force from the plate cylinder cannot be transmitted to the ink supplying mechanism. Normally, the ink supplying mechanism includes an ink reciprocation roller rotatable about its axis and reciprocally movable in its axial direction thereof. And therefore, in the OFF phase, the rotation and reciprocation of the ink reciprocation roller does not occur. In other words, any driving force for rotating and reciprocating the ink reciprocation roller is not required in the image formation process, which motion is unnecessary therefor. Accordingly, the plate cylinder can be rotated at high speed to enhance image forming efficiency on the plate cylinder. Further, surplus vibration does not occur, to enhance durability of the offset printer.

DETAILED DESCRIPTION OF THE PREFERRED EMBODIMENTS

Figure 1:
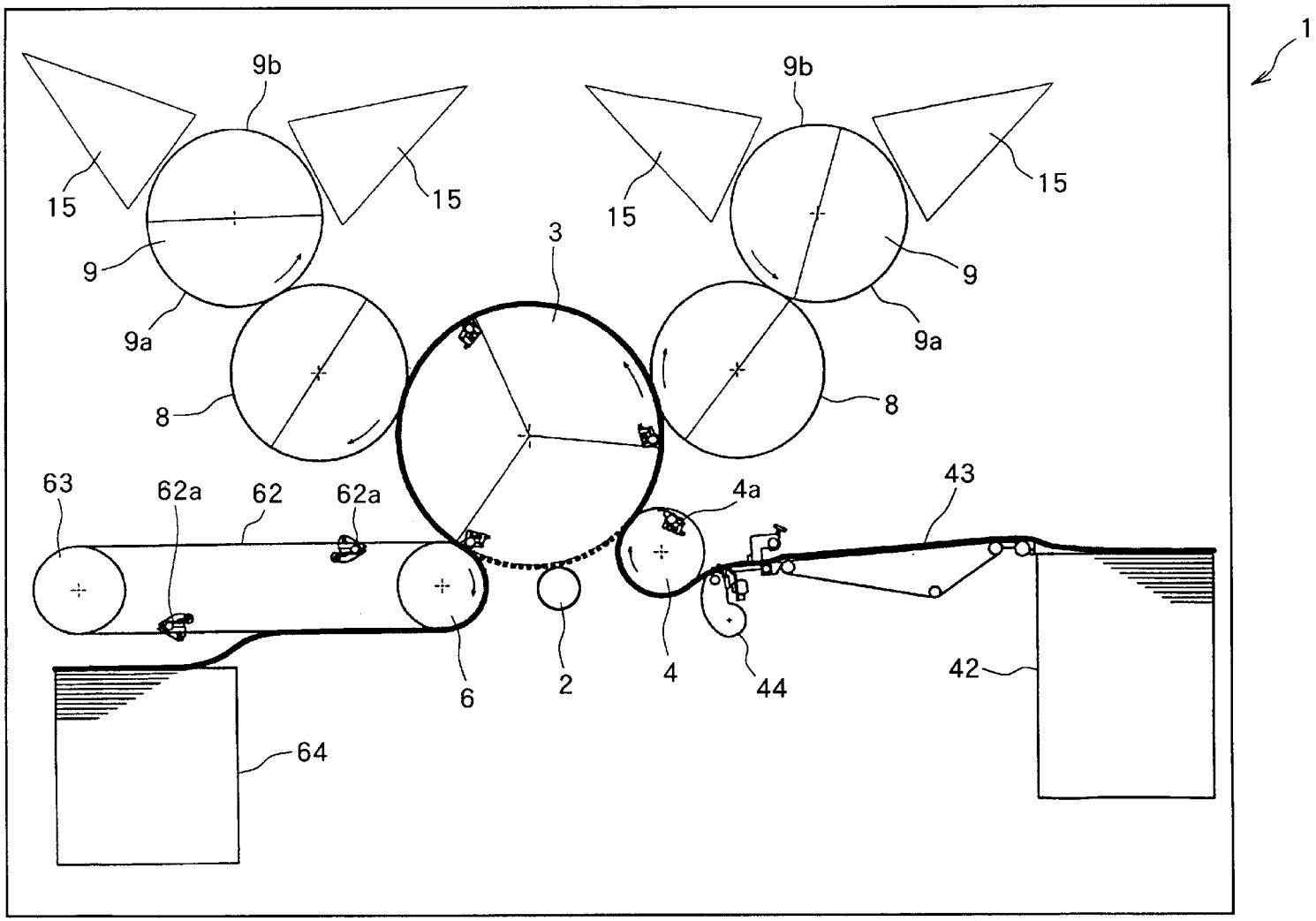
FIG. 1 is a schematic side view showing an offset printer according to one embodiment of the present invention.

An offset printer according to one embodiment of the present invention will be described with reference to FIGS. 1 through 7. FIG. 1 shows an entire arrangement of the offset printer 1. The offset printer 1 has a frame 11 (FIG. 2) to which a motor (not shown) is fixed. The motor has an output shaft (not shown) on which a drive gear 2 is mounted. The printer 1 also includes a generally cylindrical impression cylinder 3 having an impression cylinder gear (not shown) provided coaxially and integrally therewith. The drive gear 2 is meshedly engaged with the impression cylinder gear. Thus, the rotation of the motor is transmitted to the impression cylinder 3 through the drive gear 2 and the impression cylinder gear.

The printer 1 also includes a generally cylindrical paper feed cylinder 4 adapted for supplying a paper to a surface of the impression cylinder 3. A paper feed cylinder gear 41 (FIG. 2) is provided coaxially with the paper feed cylinder 4 and independently rotatable with respect to the paper feed cylinder 4. The paper fed cylinder gear 41 is meshedly engaged with the impression cylinder gear. A paper feed pile 42 is provided where a stack of papers are accommodated. A feeder board 43 and an infeed portion 44 are provided between the paper feed pile 42 and the paper feed cylinder 4. The feeder board 43 is in the form of a belt conveyer for delivering the paper from the paper feed pile 42 toward the paper feed cylinder 4. The infeed portion 44 is adapted for precisely and smoothly infeeding the paper to the paper feed cylinder 4. The infeed portion 44 is provided with a registration mechanism (not shown) including rollers for moving the paper to its correct position. A driving mechanism (not shown) driven by the rotation of the paper feed cylinder gear 41 is provided in the registration mechanism for rotating the rollers. Further, the driving force of the feeder board 43 for moving the paper from the paper feed pile 42 to the infeed portion 44 is transmitted to the feeder board 43 from the driving mechanism of the registration mechanism. The paper feed cylinder 4 has a peripheral surface provided with a paper feed pawl 4a adapted for fixing the paper to the paper feed cylinder 4 and delivering the paper to the impression cylinder 3. The paper feed pawl 4*a* is movable in a circular path together with the rotation of the paper feed cylinder 4. A combination of the paper feed cylinder 4, the paper feed pile 42, the feeder board 43 and the infeed portion 44 constitutes a paper supplying mechanism.

A generally cylindrical paper discharge portion 6 is provided for discharging the paper from the surface of the impression cylinder 3. A paper discharge portion gear 61 (FIG. 4) in meshing engagement with the impression cylinder gear is provided coaxially and integrally with the paper discharge portion 6. Therefore, the paper discharge portion 6 is rotatable upon rotation of the impression cylinder 3. An endless chain 62 is mounted between the paper discharge portion 6 and a sprocket 63 spaced away from the paper discharge portion 6. A plurality of paper discharge grippers 62*a* are provided to the endless chain 62 so as to grip the paper on the impression cylinder 3 and to remove the paper therefrom. Below the sprocket 63A, a paper discharge pile 64 is provided where each paper gripped and delivered by the gripper 62*a* and the endless chain 62 is stacked successively. The paper discharge portion 6, the endless chain 62 and the sprocket 63 are driven by the rotation force transmitted from the impression cylinder gear through the paper discharge portion gear 61. A combination of the paper discharge portion 6, the endless chain 62, the paper discharge grippers 62*a,* the sprocket 63, and the paper discharge pile 64 constitutes a paper discharge mechanism.

The offset printer 1 also includes two blanket cylinders 8 each in contact with the impression cylinder 3 and provided with blanket cylinder gear (not shown) provided coaxially and integrally with associated blanket cylinder 8. These blanket cylinder gears are in meshing engagement with the impression cylinder gear. During printing operation, the paper supplied to the surface of the impression cylinder 3 is pressed against the blanket cylinder 8 by the impression cylinder 3. The rotation force of the impression cylinder 8 is transmitted to the blanket cylinder 8 through the impression cylinder gear (not shown) and the blanket cylinder gear (not shown).

Two plate cylinders 9 are provided each in contact with each blanket cylinder 8 and each provided with a plate cylinder gear 90*a* (FIG. 6) coaxially and integrally with each plate cylinder 9. Each plate cylinder gear 90*a* is in meshing engagement with each blanket cylinder gear (not shown). Thus the rotation force of the blanket cylinder 8 is transmitted to the plate cylinder 9 through the blanket cylinder gear (not shown) and the plate cylinder gear 90*a*. A thin plate (not shown) is mounted on a surface of the plate cylinder 9. The thin plate is sectioned into two segments, i.e., a first segment 9*a* where an image for a specific color is to be formed, and a second segment 9*b* where an image for a different color is to be formed. That is, one plate cylinder 9 forms two images with two different colors, and totally four images of four different colors are formed on the two plate cylinders 9.

Figure 6:
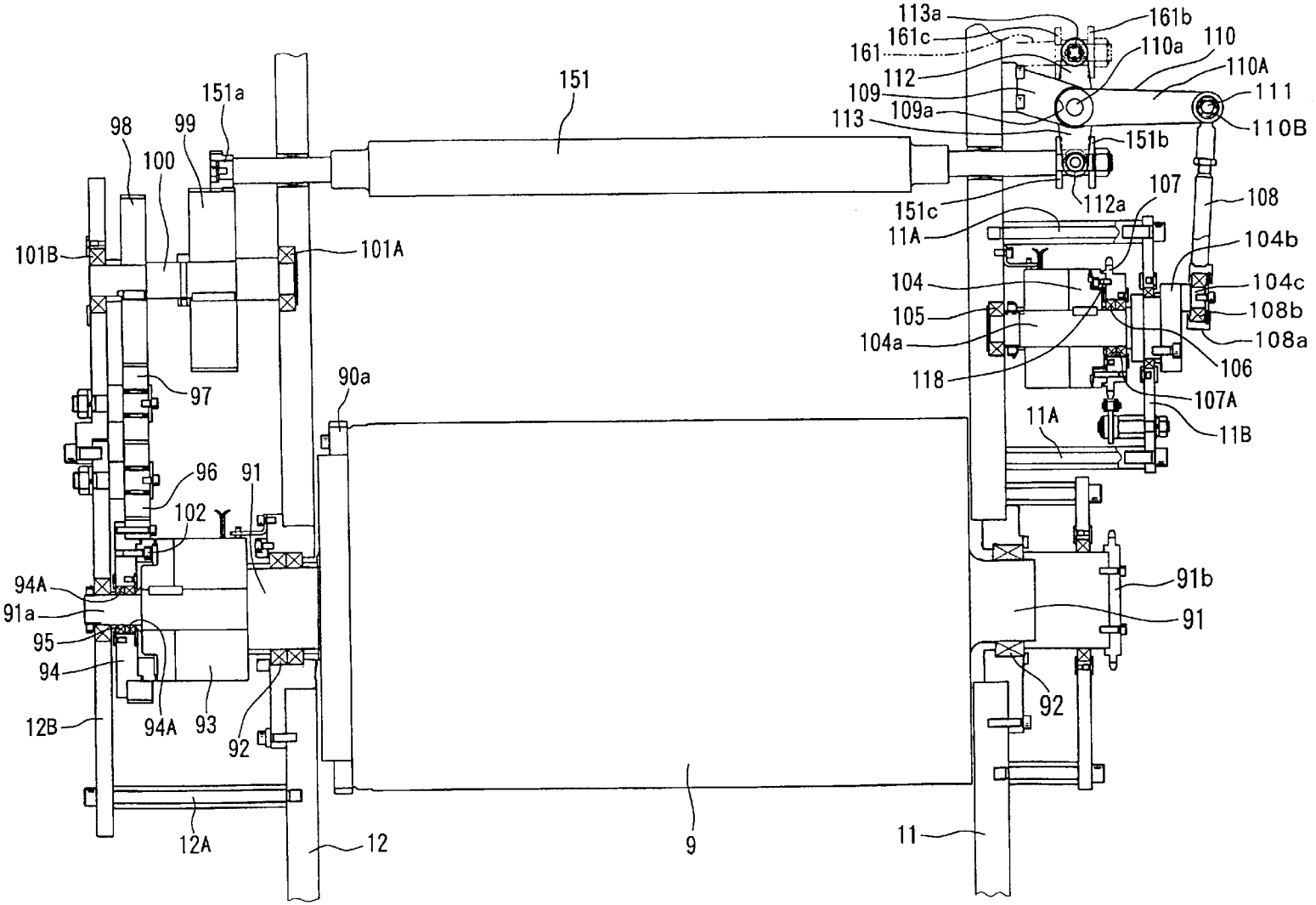
FIG. 6 is a cross-sectional and open developing view showing an essential portion around a plate cylinder according to the embodiment; and, FIG. 7 is a side view showing a reciprocation mechanism according to the embodiment of the present invention.

Two sets of ink supply units 15 are disposed adjacent to each plate cylinder 9 for supplying inks of different colors to the segments 9*a* and 9*b*. Each ink supply unit 15 includes an ink reciprocation roller 151 (FIG. 6) and an ink supply portion (not shown). The ink reciprocation roller 151 has a gear 151*a* (FIG. 6) provided coaxially and integrally therewith. As described later, the ink reciprocation roller 151 is rotatable about its axis and reciprocally movable in the axial direction. As shown in FIG. 6, the gear 151*a* is driven by the plate cylinder gear 90*a* by way of a gear train including a plurality of gears 94, 96, 97, 98 and 99. Therefore, the rotation force of the plate cylinder 9 is transmitted to the ink reciprocation roller 151 through these gears.

Figure 2:
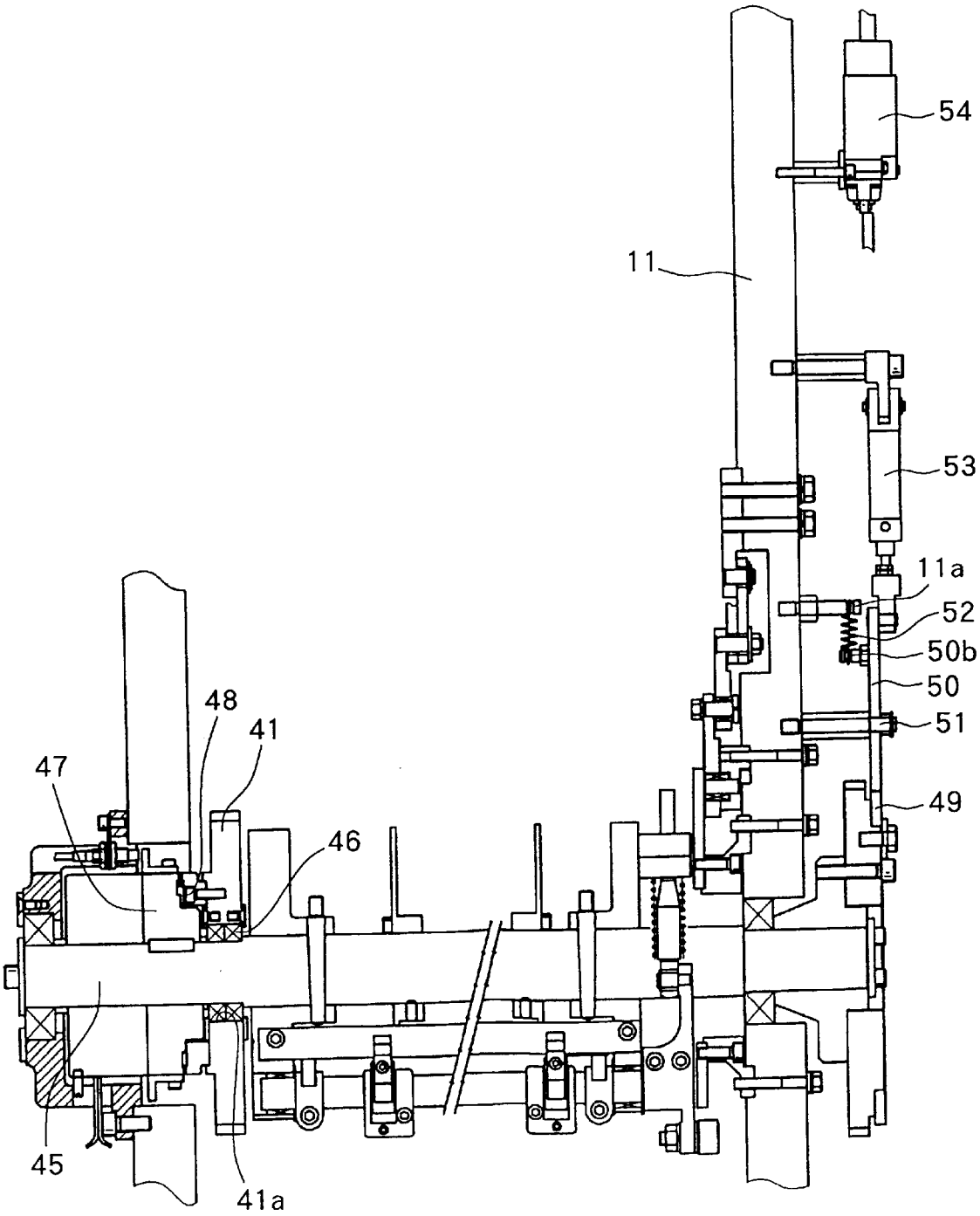
FIG. 2 is a cross-sectional view showing an essential portion around a paper feed cylinder according to the embodiment of the present invention.

Next, a mechanism around the paper feed cylinder 4 will be described with reference to FIGS. 1 through 3. The paper feed cylinder gear 41 has a disc shape formed with a central circular through hole 41*a* in which a bearing 46 is disposed. A paper feed cylinder shaft 45 extends through the through hole 41*a* through the bearing 46. The paper feed cylinder 4 (FIG. 1) is concentrically disposed over the paper feed cylinder shaft 45 and provided integrally therewith. Thus, the paper feed cylinder 4 is rotatable together with the rotation of the paper feed cylinder shaft 45. On the other hand, the paper feed cylinder gear 41 is rotatable about the paper feed cylinder shaft 45 by way of the bearing 46. In FIG. 2, beside the paper feed cylinder gear 41*a,* a generally cylindrical rotation force transmission member 47 is provided coaxially with and integrally rotatable with the paper feed cylinder shaft 45 which extends through a center portion of the transmission member 47.

An electromagnetic clutch 48 is provided between the paper feed cylinder gear 41 and the rotation force transmission member 47. If the electromagnetic clutch 48 is rendered ON, the paper feed cylinder gear 41 becomes integrally rotated with the transmission member 47 in coaxial fashion. If the electromagnetic clutch 48 is rendered OFF, the paper feed cylinder gear 41 is rotatable with respect to the transmission member 47. Because the transmission member 47 and the paper feed cylinder 4 are provided coaxially and integrally with each other, the paper feed cylinder 4 is rotated together with the rotation of the paper feed cylinder gear 41, i.e, the paper feed cylinder 4 and the paper feed cylinder gear 48 are connected together, during ON phase of the electromagnetic clutch 48, and the paper feed cylinder 4 is rotatable against the paper feed cylinder gear 41, i.e., these are disconnected from each other during OFF phase of the clutch 48. By switching the electromagnetic clutch 48 to OFF phase, the rotation force transmitted from the impression cylinder 3 to the paper feed cylinder gear 41 through the impression cylinder gear (not shown) is not transmitted to the paper feed cylinder 4. Accordingly any driving force requiring for rotating the paper feed cylinder 4 can be dispensed with, the rotation of the paper feed cylinder 4 being unnecessary for the purpose of only forming an image on the plate of the plate cylinder 8.

In FIG. 2, the right end portion of the paper feed cylinder shaft 45 is provided with an annular locking member 49 concentrically with and integrally rotatable with the paper feed cylinder shaft 45 and the paper feed cylinder 4 (FIG. 1). The annular locking member 49 has an outer peripheral surface formed with a locking depression 49A (FIG. 3) recessed radially inwardly. As shown in FIG. 3, a first locking lever 50 is positioned in confrontation with the outer peripheral surface of the annular locking member 49. The locking lever 50 has a central portion rotatably supported by a pivot shaft 51 fixed to the frame 11, so that the locking lever 50 is pivotally movable about the pivot shaft 51. The locking lever 50 has one end portion provided with a first locking projection 50*a* engageable with the locking depression 49A, and another end portion provided with a spring securing pin 50*b*. The frame 11 also has a spring securing pin 11*a*, and a tension spring 52 is bridged between the spring securing pins 50*b* and 11*a*, so that the tension spring 2 urges the first locking lever 50 to pivot about the pivot shaft 51 in a counterclockwise direction in FIG. 3. That is, the tension spring 52 urges the first locking projection 50*a* to move into the locking depression 49A.

Figure 3:
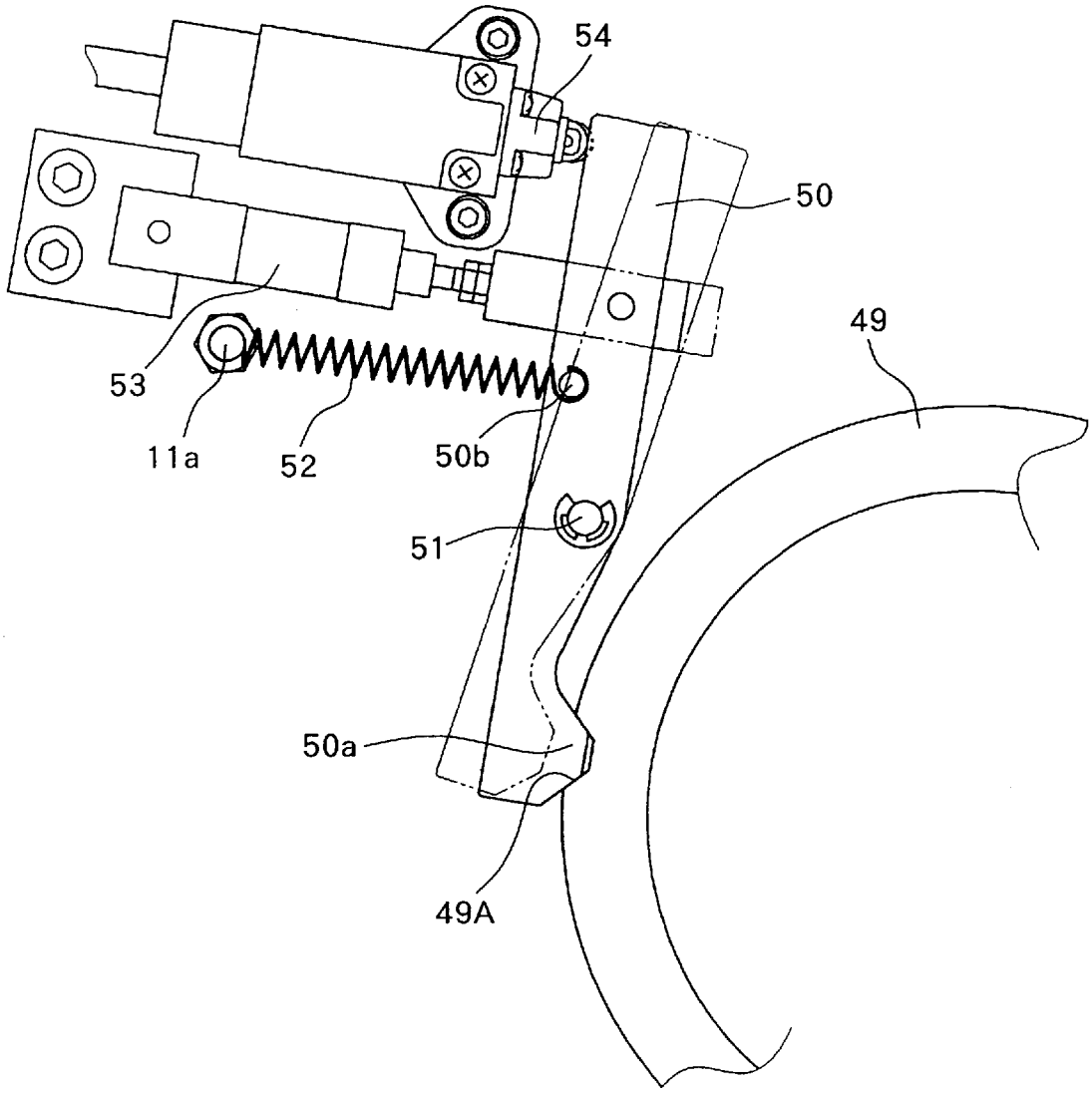
FIG. 3 is an enlarged view showing a first locking pawl and its ambient components according to the embodiment.

As shown in FIG. 3, a pneumatic cylinder 53 and a limit switch 54 are provided above the tension spring 52. The pneumatic cylinder 53 has one end fixed to the frame 11, and another end pivotally connected to the other end of the first locking lever 50 at a position above the spring securing pin 50*b*. Upon actuation of the pneumatic cylinder 53, the first locking lever 50 is pivotally moved in a clockwise direction against the biasing force of the tension spring 52 as shown by a two dotted chain line in FIG. 3, so that the first locking projection 50*a* is disengaged from the locking depression 49A. The limit switch 54 is fixed to the frame 11. The limit switch 54 has a sensing element in contact with the first locking lever 50 as shown by a solid line in FIG. 3 when the first locking projection 50*a* is engaged with the locking depression 49A. That is, detection of abutment of the limit switch 54 onto the first locking lever 50 implies a detection of the locking engagement between the locking projection 50*a* and the locking depression 49A.

The engagement of the first locking projection 50*a* with the locking depression 49A prevents the paper feed cylinder 4 integral with the annular locking member 49 from being rotated. Therefore, the positions of the paper feed pawls 4*a* provided at the periphery of the paper feed cylinder 4 can be fixed to a predetermined circularly moving position. Consequently, rotation of the impression cylinder 3 is not affected by the accidental abutment of the paper feed pawls 4*a* onto the impression cylinder 3 due to unwanted free rotation of the paper feed cylinder 4, while the driving connection between the paper feed cylinder gear 41 and the paper feed cylinder shaft 45 is shut off in the OFF phase of the electromagnetic clutch 48 during image forming process.

Figure 4:
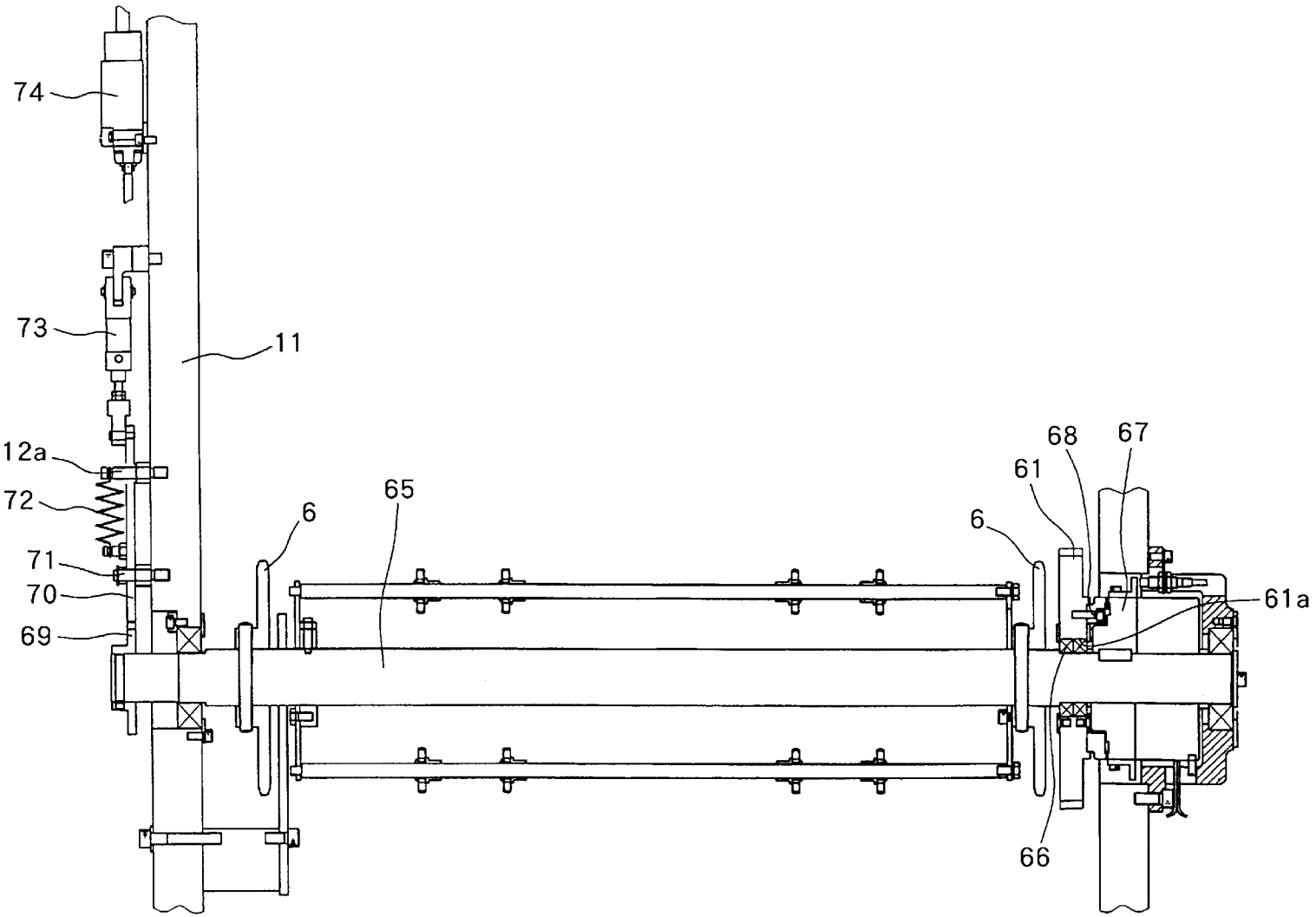
FIG. 4 is a cross-sectional view showing an essential portion around a paper discharge portion according to the embodiment.

Next, the paper discharge mechanism 6 and its ambient arrangement will be described. As shown in FIG. 4, a disc shaped paper discharge gear 61 formed with a central circular through hole 61*a* is provided, and a bearing 66 is disposed in the through hole 61*a*. A paper discharge shaft 65 extends through the bearing 66. Thus, the paper discharge gear 61 is provided coaxilly with and rotatable with respect to the paper discharge shaft 65 through the bearing 66. The paper discharge portion 6 is rotatable coaxially and integrally with the paper discharge shaft 65. In FIG. 4, a generally cylindrical rotation force transmission member 67 is positioned at right side of the paper discharge gear 61. The transmission member 67 has a center portion through which the paper discharge shaft 65 extends, and is coaxially and integrally with the paper discharge shaft 65. An electromagnetic clutch 68 is disposed between the paper discharge gear 61 and the rotation force transmission member 67. If the electromagnetic clutch 68 is rendered ON, the transmission member 67 and the paper discharge gear 61 are coupled together, so that these are rotated together. If the clutch 68 is rendered OFF, the paper discharge gear 61 becomes rotatable coaxially with respect to the transmission member 67. Because the transmission member 67 and the paper discharge portion 6 are coaxially and integrally rotatable together, the paper discharge portion 6 is integrally rotated with the paper discharge gear 61, i.e., the paper discharge portion 6 and the paper discharge gear 61 are connected together, if the electromagnetic clutch 68 is rendered ON, and the paper discharge portion 6 becomes rotatable with respect to the paper discharge gear 61, i.e., the paper discharge portion 6 is disconnected from the paper discharge gear 61, if the clutch 68 is rendered OFF.

In OFF phase of the electromagnetic clutch 68, the rotation force transmitted from the impression cylinder 3 through the impression cylinder gear (not shown) and the paper discharge gear 61 is not transmitted to the paper discharge portion 6. Accordingly, a driving power for rotating the paper discharge portion 6 is unnecessary during image formation on the plate of the plate cylinder. Thus, power saving results.

Figure 5:
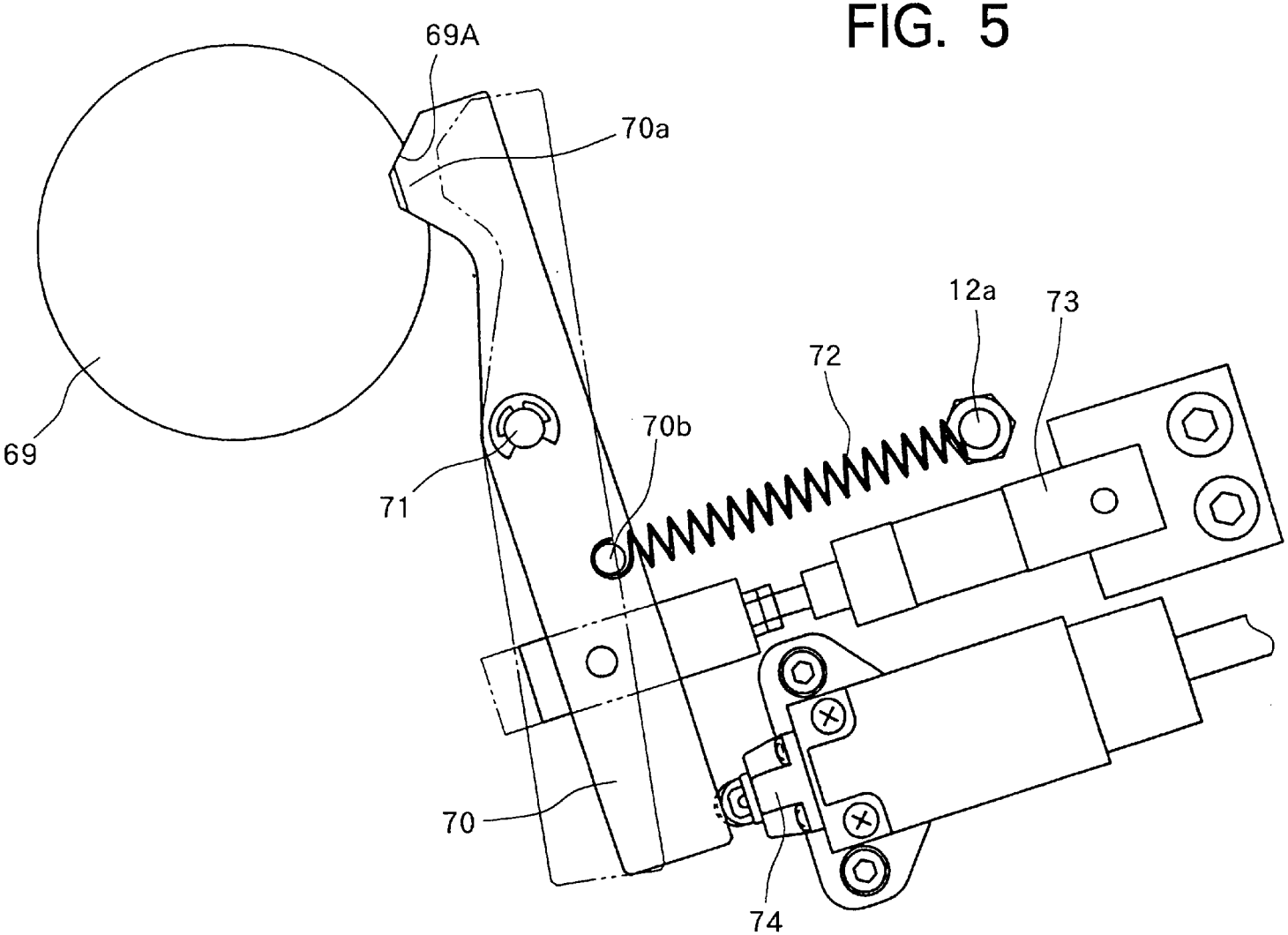
FIG. 5 is an enlarged view showing a second locking pawl and its ambient components according to the embodiment.

In FIG. 4, a disc shaped locking member 69 is provided at a leftmost end of the paper discharge shaft 65 integrally and coaxially therewith. The locking member 69 is formed with a radially inwardly recessed locking depression 69A (FIG. 5). Further, a second locking lever 70 is pivotally movably positioned in confrontation with an outer peripheral surface of the locking member 69 as shown in FIG. 5. The second locking lever 70 has an intermediate portion pivotally supported to a pivot shaft 71 fixed to the frame 11 (FIG. 4), a one end portion having a second locking projection 70*a* engageable with the locking depression 69A, and another end portion having a spring securing pin 70*b*. The frame 11 also has a spring securing pin 12*a*, and a tension spring 72 is bridged between the spring securing pins 12*a* and 70*b*, so that the tension spring 72 urges the second locking lever 70 to pivot about the pivot shaft 71 in a direction to provide engagement between the second locking projection 70*a* and the locking depression 69A as best shown in FIG. 5.

In FIG. 5, a pneumatic cylinder 73 and a limit switch 74 are provided below the tension spring 72. The pneumatic cylinder 73 has a base end fixed to the frame 11, and a free end pivotally connected to the second locking lever 70 at a position below the spring securing pin 70*b*. Upon actuation of the pneumatic cylinder 73, the second locking lever 70 is pivotally moved about the pivot pin 71 in a clockwise direction in FIG. 5 as shown by a two dotted chain line against the biasing force of the tension spring 72, so that the second locking projection 70*a* is disengaged from the locking depression 69A. The limit switch 74 is fixed to the frame 11. When the second locking projection 70*a* is engaged with the locking depression 69A, one end of the limit switch 74 is in abutment with the second locking lever 70 as shown by a solid line in FIG. 5. That is, abutment of the limit switch 74 onto the second locking lever 70 implies a detection of locking engagement between the second locking projection 70*a* and the locking depression 69A.

The engagement between the second locking projection 70*a* and the locking depression 69A prevents the paper discharge portion 6 integrally rotatable with the disc shaped locking member 69 from being rotated. Therefore, during image forming process on the plate of the plate cylinder, the paper discharge grippers 62*a* (FIG. 1) provided to the endless chain 62 can be maintained at their fixed positions. Accordingly, rotation of the impression cylinder 3 is not affected by the paper discharge grippers 62, because accidental abutment of the gripper onto the surface of the impression cylinder 3 can be prevented.

Next, a mechanism for rotating an ink reciprocation roller 151 will be described with reference to FIG. 6. As described above, the plate cylinder gear 90*a* is provided coaxially and integrally rotatable with the plate cylinder 9, and the rotation force of the blanket cylinder gear (not shown) is transmitted to the plate cylinder 9 through the plate cylinder gear 90*a*. A plate cylinder shaft 91 is provided integrally with the plate cylinder 9, and is rotatably supported by the frame 11, 12 through bearing 92. The plate cylinder shaft 91 has one distal end portion coaxially provided with an extension portion 91*a* whose radius is smaller than that of the plate cylinder shaft 91. Further, at left side of the plate cylinder shaft 91 in FIG. 6, a generally cylindrical rotation force transmission member 93 is provided coaxially and integrally rotatably with the plate cylinder shaft 91. The transmission member 93 has a radius greater than that of the plate cylinder shaft 91.

A sub frame 12B is fixed to the frame 12 by a stud 12A and extends in a direction parallel with the frame 12. The extension portion 91*a* is rotatably supported by the sub frame 12B through a bearing. The above described gear 94 of the gear train is positioned between the power transmission member 93 and the sub frame 12B. The gear 94 has a central portion formed with a through hole 94A through which the extension portion 91*a* extends via a bearing 95. Thus, the gear 94 is coaxially rotatable about the extension portion 91*a*. Further, the above described gears 96, 97, and 98 of the gear train are rotatably supported to the sub frame 12B. The gear 94 is meshedly engaged with the gear 96 meshedly engaged with the gear 97. The gear 97 is meshedly engaged with the gear 98 provided coaxially and integrally rotatable with the gear 99. These gears 98 and 99 are coaxially and integrally mounted on a shaft 100 having one end rotatably supported to the frame 12 through a bearing 101A, and another end rotatably supported to the sub frame 12B through a bearing 101B. In FIG. 6, a gear 151*a* in meshing engagement with the gear 99 is coaxially and integrally rotatable with the ink reciprocation roller 151 at a left end thereof. Because the ink reciprocation roller 151 is reciprocally movable in its axial direction, the gear 99 has a sufficient axial length capable of maintaining meshing engagement with the gear 151*a* in spite of the reciprocal movement of the gear 151*a* in its axial direction.

An electromagnetic clutch 102 is disposed between the gear 94 and the rotation force transmission member 93. If the clutch 102 is rendered ON, the gear 94 and the transmission member 93 is coupled together, and if the clutch 102 is rendered OFF, the gear 94 is rotatable with respect to the transmission member 93. In other words, in ON phase of the electromagnetic clutch 102, rotation force of the plate cylinder 9 can be transmitted to the gear 151*a* through the rotation force transmission member 93, and the gears 94, 96, 97, 98 and 99. Therefore, upon rotation of the plate cylinder 9, the ink reciprocation roller 151 is rotated about its axis. On the other hand, in OFF phase of the electromagnetic clutch 102, rotation force transmission from the transmission member 93 to the gear 94 is shut off. Therefore, the ink reciprocation roller 151 is not rotated about its axis in spite of the rotation of the plate cylinder 9.

With the OFF phase of the electromagnetic clutch 102, the rotation force transmitted to the plate cylinder gear 90*a* through the impression cylinder gear (not shown) and the blanket cylinder gear (not shown) is not transmitted to the ink reciprocation roller 151 but is shut off at the gear 94. Consequently, in the image forming process, a driving power for driving the ink supplying device 15 including the ink reciprocation roller 151 can be dispensed with, the power being unnecessary for forming an image on the plate of the plate cylinder 9.

Next, a mechanism for reciprocating ink reciprocation rollers 151, 161, 171 in their axial direction will be described with reference to FIGS. 6 and 7. In FIG. 6, the plate cylinder shaft 91 has a right end provided with a pulley 91*b* coaxially and integrally therewith, and an endless belt 103 (FIG. 7) is mounted on the pulley 91*b*. A sub frame 11B is fixed to the frame 11 by studs 11A and extends in parallel with the frame 11. An intermediate rotation force transmission member 104 and a pulley 107 are positioned between the frame 11 and the sub frame 11B. More specifically, a rotation shaft 104*a* extends between the frame 11 and the sub frame 11B and is rotatably supported thereto through bearings 105. The transmission member 104 is provided integrally and coaxially with the shaft 104*a*. The pulley 107 is positioned at right side of the transmission member 104 in FIG. 6, and is formed with a central through hole 107A, through which the rotation shaft 104*a* extends via a bearing 106. Thus, the pulley 107 is coaxially rotatable about the rotation shaft 104*a*. The endless belt 103 is mounted on the pulley 107, so that the rotation force of the pulley 91*b* can be transmitted to the pulley 107 by way of the endless belt 103.

An electromagnetic clutch 118 is disposed between the intermediate rotation force transmission member 104 and the pulley 107. If the clutch 118 is rendered ON, the transmission member 104 and the pulley 107 are coaxially and integrally rotatable. If the clutch 118 is rendered OFF, the transmission member 104 is rotatable with respect to the pulley 107. That is, in ON phase of the clutch 118, the rotation force of the plate cylinder 9 can be converted into reciprocally moving force of the ink reciprocation rollers 151, 161, 171, and in OFF phase of the clutch 118, the power transmission from the plate cylinder 9 to the ink reciprocation rollers 151, 161, 171 is shut off.

In FIG. 6, a disc shaped rotation member 104*b* is provided coaxially and integrally rotatable with the rotation shaft 104*a* at a rightmost end thereof. The rotation member 104*b* is rotatably supported to the sub frame 11B. A rod support portion 104*c* is provided on the rotation member 104*b* at an eccentric position with respect to the rotation shaft 104*a*. Further, one end 108*a* of a rod 108 is rotatably connected to the rod support portion 104*c* through a bearing 108*b*.

A bracket 109 extends from the frame 11, and a reciprocation drive member 110 is supported by the bracket 109. The reciprocation drive member 110 includes a support portion 110, a pair of arm portions 113, 112 and a lever 110A. The support portion 110 is rotatably supported by the bracket 109 and extends in a direction parallel with the frame 11. The pair of arm portions 113, 112 extend from the support portion 110 in opposite directions and perpendicular to a rotation axis of the support portion 110*a*. The lever 110A has one end connected to the support portion 110 and another end pivotally connected to another end of the rod 108. The arm portion 113 has a free end to which one end of the rotation shaft of the ink reciprocation roller 151 is pivotally connected.

To be more specific, as shown in FIG. 6, a rightmost end 109*a* of the bracket 109 is in a hollow cylindrical shape, through which the support portion 110*a* of the reciprocation drive member 110 extends in a direction perpendicular to a sheet of drawing. The right end of the lever 110A is formed with a through hole 11B, and the other end of the rod 108 is also formed with a through hole (not shown). A pivot shaft 111 extends through these through holes, so that the rod 108 is pivotally connected to the lever 11A.

Figure 7:
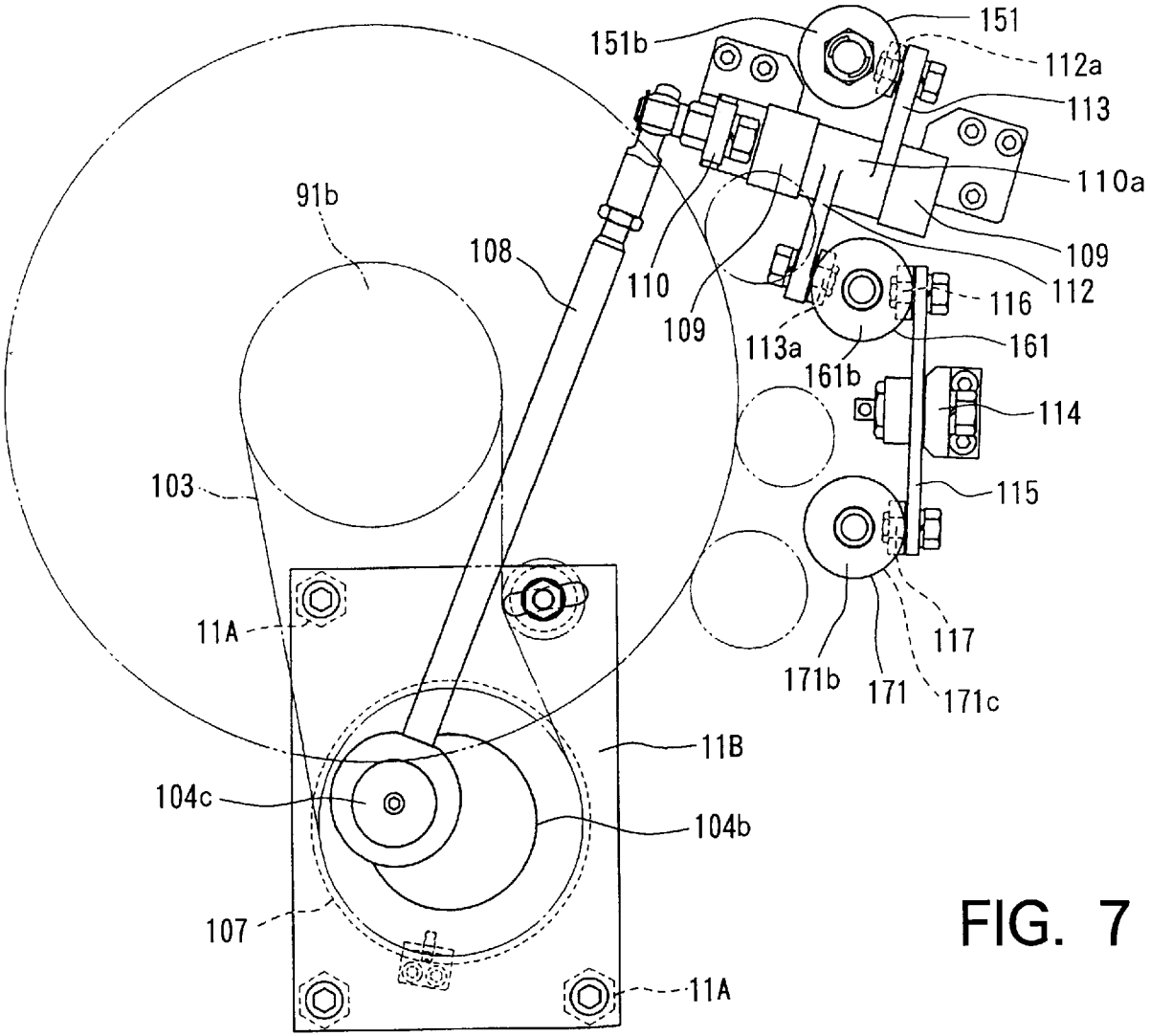

As best shown in FIG. 7, the pair of arm portions 112, 113 integrally extend from the support portion 110*a* in such a manner that one arm portion 112 extends upwardly, and the other arm portion 113 extends downwardly in FIG. 7. Free ends of the arm portions 112, 113 are provided with ink reciprocation roller securing nuts 112*a*, 113*a*, respectively. As shown in FIG. 6, nut holding flanges 151*b*, 151*c* are provided at right side of the ink reciprocation roller 151 for interposing therebetween the nut 112*a*. Similarly, at right side of the ink reciprocation roller 161, nut holding flanges 161*b*, 161*c* are provided for interposing therebetween the ink reciprocation roller securing nut 113*a*.

As shown in FIG. 7, a pivot shaft 114 is provided on the frame 11 (FIG. 6). and an intermediate portion of a reciprocation force transmission arm 115 is pivotally supported to the pivot shaft 114. The arm 115 has free ends where ink reciprocation roller securing nuts 116, 117 are provided, respectively. The nut 116 is connected to one end of the shaft of the ink reciprocation roller 161 in cooperation with the ink reciprocation roller securing nut 113*a*. That is, the nut 116 is interposed between the nut holding flanges 161*b* and 161*c* which interpose therebetween the nut 113*a*. Further, the end portion of the shaft of the ink reciprocation roller 171 is provided with nut holding flanges 171*b*, 171*c*, and the ink reciprocation roller securing nut 117 is interposed between the flanges 171*b* and 171*c*.

Next, power transmission from the plate cylinder 9 will be described for performing reciprocal motion of the ink reciprocation rollers 151, 161, 171. Assuming that the electromagnetic clutch 118 is ON phase, when the plate cylinder 9 is rotated, the pulley 91*b* is integrally rotated, so that the pulley 107 is rotated by way of the endless belt 103. Since the pulley 107 is rotatable together with the rotation of the intermediate power transmission member 104, the rotation shaft 104*a* and the rotation member 104*c* in ON phase of the electromagnetic clutch 118, the rotation member 104*b* is also rotated, so that the rod support portion 104*c* is eccentrically rotated.

The eccentric rotation of the rod support portion 104*c* is converted into reciprocating motion of the rod 108, which in turn pivotally moves the lever 110A about an axis of the support portion 110*a*. Thus, the support portion 110*a* of the reciprocation drive member 110 is angularly rotated to and fro about its axis. By the reciprocal angular rotation of the support portion 110*a*, the arm portions 113, 112 are pivotally moved about the axis of the support portion 110*a* to and fro, i.e., rightwardly and leftwardly in FIG. 6. Consequently, the ink reciprocation rollers 151,161 are axially reciprocatingly moved through the associated nuts 112*a*, 113*a* and nut holding flanges 151*b*, 151*c*, 161*b*, 161*c*. By the axially reciprocating motion of the ink reciprocation roller 161, the ink reciprocation roller 171 is also reciprocally moved in its axial direction by way of the transmission arm 115, the nut 117 and the flanges 171*b*, 171*c*. Thus, totally three ink reciprocation rollers 151, 161 and 171 are concurrently reciprocally moved in their axial direction, whereby ink on the surface of the plate of the plate cylinder 9 can be kneaded. It should be noted that FIG. 6 shows an open developing view for better understanding the power transmission mechanisms at positions outside the frames 11 and 12. In reality, the ink reciprocation roller 151 should be delineated to be in contact with the plate cylinder 9 for kneading.

If the electromagnetic clutch 118 is turned OFF, the pulley 107 becomes rotatable with respect to the intermediate power transmission member 104. Therefore, even though the rotation of the pulley 91*b* is transmitted to the pulley 107 via the belt 103, the rotation force of the pulley 107 is not transmitted to the ink reciprocation rollers 151, 161, 171. Accordingly, axially reciprocal motion of these rollers does not occur. With the OFF state of the electromagnetic clutch 118, the rotation force transmitted to the plate cylinder gear 90*a* through the impression cylinder gear (not shown) and the blanket cylinder gear (not shown) is not transmitted to the ink reciprocation rollers 151, 161, 171 by way of the reciprocation mechanism. Accordingly, during image forming process, reciprocating motion of the ink reciprocation rollers can be prevented, which motion is unnecessary for forming an image on the plate.

While the invention has been described in detail and with reference to the specific embodiments thereof, it would be apparent to those skilled in the art that various changes and modifications may be made therein without departing from the spirit and scope of the invention.

For example, in the illustrated embodiment, the drive gear 2 of the motor is positioned below the impression cylinder 3 as shown in FIG. 1. However, any position is available as long as the drive gear 2 is in meshing engagement with the impression cylinder gear for rotating the impression cylinder 3.

Further, in the above described embodiment, during image formation process on the plate cylinder 9, driving operation of the paper feed mechanism, the paper discharge mechanism and the ink supplying mechanism are suspended. However, driving operation of at least one of the mechanisms can be suspended during the image formation process.

Further, number of ink colors is not limited to four ink colors, but any other numbers of colors can be used for multiple color printing.

Further, in the above embodiment, the image is formed on the thin plate mounted on the surface of the plate cylinder 9. However, the image can be directly formed on the outer peripheral surface of the plate cylinder without employment of the thin plate.

Further, the above described embodiment is available for any types of offset printer other than the digital type offset printer.

What is claimed is:

1. An offset printer comprising:

a frame;

a drive motor supported on the frame;

a drive gear for outputting a rotation force of the drive motor an impression cylinder having an impression cylinder gear provided coaxially and integrally rotatable therewith, the impression cylinder gear being meshedly engaged with the drive gear for rotating the impression cylinder upon rotation of the drive gear;

a paper feed mechanism comprising a paper feed cylinder gear meshedly engaged with the impression cylinder gear, and a paper feed cylinder rotatable coaxially with the paper feed cylinder gear upon rotation of the impression cylinder gear for feeding a paper to a surface of the impression cylinder;

a paper discharge mechanism comprising a paper discharge gear meshedly engaged with the impression cylinder gear, a paper discharge portion rotatable coaxially with the paper discharge gear, and an endless chain mounted on the paper discharge portion and circularly movable on the paper discharge portion for removing the paper from the impression cylinder;

a blanket cylinder in contact with the surface of the impression cylinder and having a blanket cylinder gear meshedly engaged with the impression cylinder gear, the blanket cylinder gear being rotatable integrally with the blanket cylinder upon rotation of the impression cylinder gear;

a plate cylinder having a plate cylinder gear meshedly engaged with the blanket cylinder gear, the plate cylinder being rotatable integrally and coaxially with the plate cylinder gear upon rotation of the blanket cylinder gear and in contact with a surface of the blanket cylinder for forming an image on a surface of the plate cylinder;

an ink supplying mechanism driven by the rotation of the plate cylinder for supplying an ink to the surface of the plate cylinder, an inked image being formed on the surface of the plate cylinder by the supplied ink based on an image formed on the surface of the plate cylinder, and the inked image on the plate cylinder being transferred to the surface of the blanket cylinder, and the impression cylinder pressing a paper against the surface of the blanket cylinder for transferring the inked image on the blanket cylinder to the paper; and a power transmission shut off mechanism for preventing the rotation force of the drive motor from being transmitted to at least one of the paper feed mechanism, the paper discharge mechanism and the ink supplying mechanism at least during image formation process on the surface of the plate cylinder.

2. The offset printer as claimed in claim 1, wherein the power transmission shut off mechanism comprises an electromagnetic clutch positioned between the paper feed cylinder gear and the paper feed cylinder for selectively coupling the paper feed cylinder gear and the paper feed cylinder.

3. The offset printer as claimed in claim 2, further comprising a rotation preventing member having a locking projection engageable with the paper feed cylinder for preventing the paper feed cylinder from being rotated with respect to the frame when the electromagnetic clutch disconnects the paper feed cylinder gear from the paper feed cylinder, the locking projection being disengageable from the paper feed cylinder for allowing the paper feed cylinder to be rotatable with respect to the frame when the electromagnetic clutch couples the paper feed cylinder gear to the paper feed cylinder.

4. The offset printer as claimed in claim 1, wherein the power transmission shut off mechanism comprises an electromagnetic clutch positioned between the paper discharge gear and the paper discharge portion for selectively coupling the paper discharge gear and the paper discharge portion.

5. The offset printer as claimed in claim 4, further comprising a rotation preventing member having a locking projection engageable with the paper discharge portion for preventing the paper discharge portion from being rotated with respect to the frame when the electromagnetic clutch disconnects the paper discharge gear from the paper discharge portion, the locking projection being disengageable from the paper discharge portion for allowing the paper discharge portion to be rotatable with respect to the frame when the electromagnetic clutch couples the paper discharge gear to the paper discharge portion.

6. The offset printer as claimed in claim 1, wherein the power transmission shut off mechanism comprises a clutch positioned between the plate cylinder and the ink supplying mechanism for selectively shutting off transmission of rotation force of the plate cylinder to the ink supplying mechanism.

7. The offset printer as claimed in claim 6, wherein the clutch comprises a first electromagnetic clutch and a second electromagnetic clutch; and wherein the ink supplying mechanism comprises:

an ink reciprocation roller rotatable about its axis and movable in an axial direction thereof, the ink reciprocation roller being in contact with the plate cylinder;

a rotation transmission mechanism for transmitting rotation of the plate cylinder gear to the ink reciprocation roller for rotating the ink reciprocation roller, the first electromagnetic clutch provided in the rotation transmission mechanism for selectively shutting off the transmission of rotation of the plate cylinder gear to the ink reciprocation roller; and, a conversion mechanism for transmitting rotation of the plate cylinder gear and converting rotary motion of the plate cylinder gear into reciprocating motion of the ink reciprocation roller, the second electromagnetic clutch provided in the conversion mechanism for selectively shutting off the transmission of rotation of the plate cylinder gear to the ink reciprocation roller.

8. The offset printer as claimed in claim 1, wherein the power transmission shut off mechanism comprises:

a first electromagnetic clutch positioned between the paper feed cylinder gear and the paper feed cylinder for selectively coupling the paper feed cylinder gear and the paper feed cylinder;

a second electromagnetic clutch positioned between the paper discharge gear and the paper discharge portion for selectively coupling the paper discharge gear and the paper discharge portion; and a set of clutches positioned between the plate cylinder and the ink supplying mechanism for selectively shutting off the transmission of rotation force of the plate cylinder to the ink supplying mechanism.

9. The offset printer as claimed in claim 8, further comprising a first rotation preventing member having a first locking projection engageable with the paper feed cylinder for preventing the paper feed cylinder from being rotated with respect to the frame when the first electromagnetic clutch disconnects the paper feed cylinder gear from the paper feed cylinder, the first locking projection being disengageable from the paper feed cylinder for allowing the paper feed cylinder to be rotatable with respect to the frame when the first electromagnetic clutch couples the paper feed cylinder gear to the paper feed cylinder.

10. The offset printer as claimed in claim 9, further comprising a second rotation preventing member having a second locking projection engageable with the paper discharge portion for preventing the paper discharge portion from being rotated with respect to the frame when the second electromagnetic clutch disconnects the paper discharge gear from the paper discharge portion, the second locking projection being disengageable from the paper discharge portion for allowing the paper discharge portion to be rotatable with respect to the frame when the second electromagnetic clutch couples the paper discharge gear to the paper discharge portion.

11. The offset printer as claimed in claim 10, wherein the set of clutches comprises a third electromagnetic clutch and a fourth electromagnetic clutch; and wherein the ink supplying mechanism comprises:

an ink reciprocation roller rotatable about its axis and movable in an axial direction thereof, the ink reciprocation roller being in contact with the plate cylinder;

a rotation transmission mechanism for transmitting rotation of the plate cylinder gear to the ink reciprocation roller for rotating the ink reciprocation roller, the third electromagnetic clutch provided in the rotation transmission mechanism for selectively shutting off the transmission of rotation of the plate cylinder gear to the ink reciprocation roller; and a conversion mechanism for transmitting rotation of the plate cylinder gear and converting rotary motion of the plate cylinder gear into reciprocating motion of the ink reciprocation roller, the fourth electromagnetic clutch provided in the conversion mechanism for selectively shutting off the transmission of rotation of the plate cylinder gear to the ink reciprocation roller.

* * * * *